US005262826A

United States Patent [19]

Hediger

[11] Patent Number: 5,262,826

[45] Date of Patent: Nov. 16, 1993

[54] FRICTION AND SPROCKET DRIVE BELT SYSTEM

[75] Inventor: Edwin A. Hediger, Fairport, N.Y.

[73] Assignee: Eastman Kodak Company, Rochester, N.Y.

[21] Appl. No.: 933,619

[22] Filed: Aug. 21, 1992

Related U.S. Application Data

[63] Continuation of Ser. No. 767,450, Sep. 30, 1991, abandoned.

[51] Int. Cl.[5] ..... G03G 5/00

[52] U.S. Cl. ..... 355/212; 355/271

[58] Field of Search ..... 355/212, 200, 210, 211, 355/271, 273; 474/153, 159, 134

[56] References Cited

U.S. PATENT DOCUMENTS

| | | | |
|---|---|---|---|
| Re. 29,406 | 9/1977 | Walker-Arnott | 355/308 |
| 4,068,946 | 1/1978 | Eschweiler et al. | 355/64 |
| 4,662,767 | 5/1987 | Pimintel | 400/616.2 |
| 4,714,939 | 12/1987 | Ahern et al. | 355/275 |
| 4,821,066 | 4/1989 | Foote, Jr. et al. | 355/212 |
| 4,884,105 | 11/1989 | Joseph et al. | 355/212 |
| 4,884,106 | 11/1989 | Harris | 355/212 |
| 4,937,635 | 6/1990 | Paxon et al. | 355/212 |
| 5,036,360 | 7/1991 | Paxon et al. | 355/212 |
| 5,089,855 | 2/1992 | Mochimaru | 355/271 |

*Primary Examiner*—A. T. Grimley
*Assistant Examiner*—Shuk Y. Lee
*Attorney, Agent, or Firm*—J. Gary Mohr

[57] ABSTRACT

A recording apparatus of the type having an endless movable belt on which an image is formed and transferred in registration to a transfer surface. Registration between the transfer roller and the printhead is provided in part by a sprocket engaging the belt through a series of perforation along an edge of the belt. Prolonged integrity and increased load carrying capacity of the perforations are obtained by having a sprocket drive that drives the belt through its perforations in cooperation with a friction drive for driving the belt.

11 Claims, 3 Drawing Sheets

FRICTION AND SPROCKET DRIVE BELT SYSTEM

This is a continuation of application Ser. No. 07/767,450, filed Sep. 30, 1991 now abandoned.

FIELD OF THE INVENTION

This invention relates generally to a recording apparatus and the drive for an image receiving belt used in said apparatus.

BACKGROUND OF THE INVENTION

U.S. Pat. No. 4,821,066 issued Apr. 11, 1989 to James C. Foote, Jr., Frank Castrignano and Robert D. Huot shows a color printer having an electrophotographic endless belt entrained about a series of rollers. The endless belt has a series of perforations along one edge. A printhead roller sprocket and a transfer sprocket are provided for engaging an edge of each perforation to provide registration between the printhead and the transfer roller for the production of high quality color reproduction. The transfer sprocket also provides the drive for the belt by engagement with the perforations of the belt. In this patent errors in image formation, due to perforation formation error, are corrected by having the same perforation control both transfer and image formation.

The above registration and drive system, however, is highly reliant upon tolerances and continued integrity of the belt perforations for quality imaging, as indicated by the following:

1. The teeth of the printhead roller sprocket are to be constantly engaging an edge of the perforations to assure that the angular position of the printhead roller sprocket is representative of exact belt position;

2. The pitch of the sprocket teeth, as determined by the pitch of the perforations, must be such that only the proper tooth of the transfer sprocket and the printhead roller sprocket control location of the transfer surface and exposure, respectively; and 3. Very tight tolerances, + or −0.015 mm, on the length of each perforation must be maintained if the teeth of the transfer sprocket engage one edge of the perforation and the teeth of the printhead roller sprocket engage another edge of the perforation.

Errors, of even a small magnitude in the above, which may be the result of damage to the perforation caused by the driving sprocket, may result in loss of resolution, poor image color alignment and may also result in a shift in the hue of colors that result from the combination of two different toners.

Even though the above disclosed system works very well, there is a chance of the perforations wearing due to the constant engagement of the sprocket teeth with the performations as the sprocket drives the belt. This could, without belt replacement, affect registration of the system.

SUMMARY OF THE INVENTION

An improved drive system for a recording apparatus of the type having a belt with a series of perforations along one edge wherein the drive system improvement comprises an engagement means for driving the belt through the perforations in combination with a frictional means for driving the belt.

An object of the invention is to provide a drive that prolongs the integrity of the belt perforations, so that registration, which is highly reliant on perforation integrity, can be maintained without frequent belt replacement.

DESCRIPTION OF THE PREFERRED EMBODIMENT OF THE INVENTION

In describing the preferred embodiment of the instant invention, reference is made to the drawings, wherein like numerals indicate like parts and structural features in the various views, diagrams and drawings. For the sake of discussion, but not limitation, the preferred embodiment of the present invention will be described in relation to a nonimpact printer apparatus.

Figure 1:
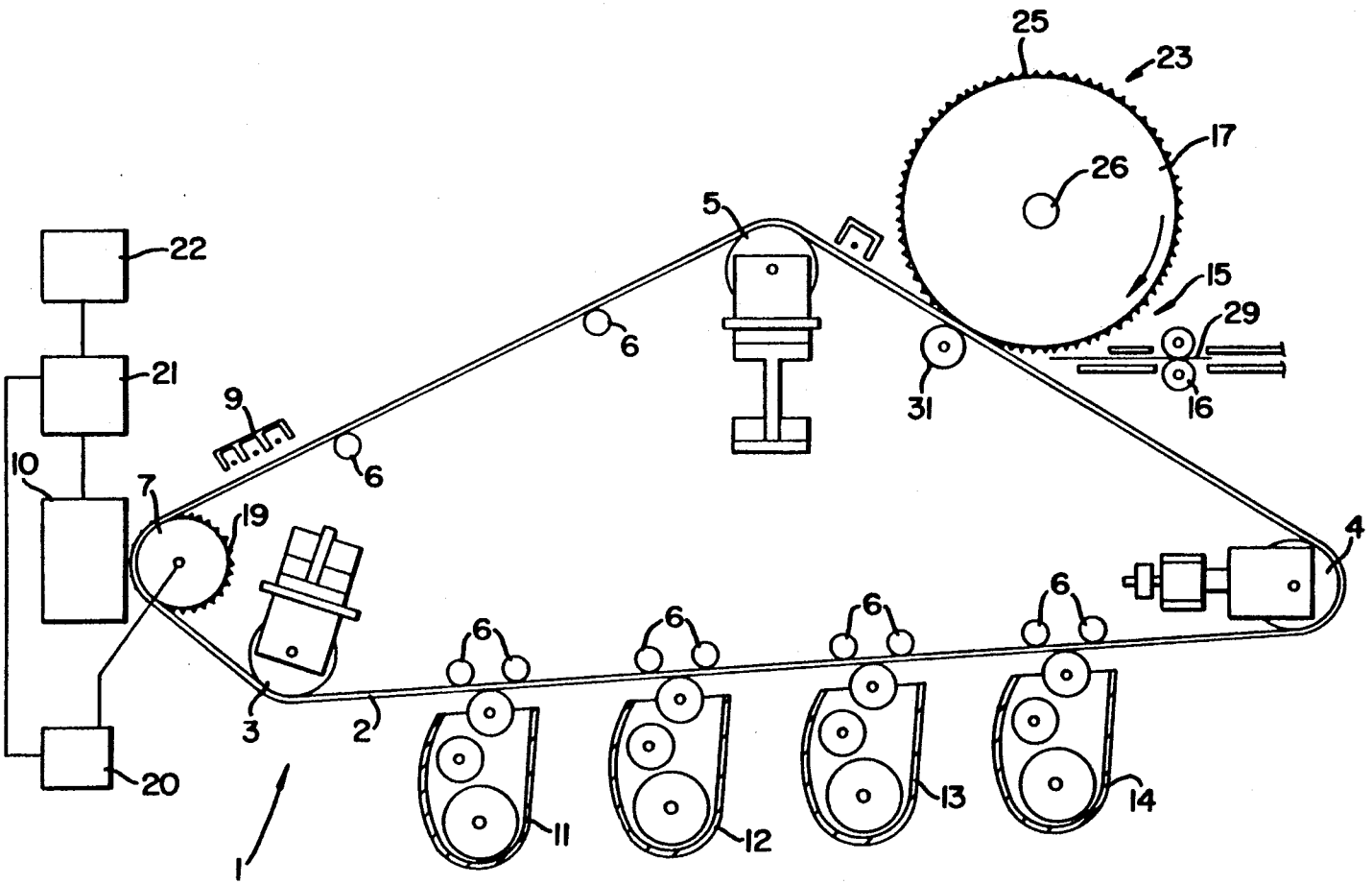
FIG. 1 is a schematic side view of a recording apparatus in accordance with the present invention, but with parts eliminated for clarity of illustration.
Figure 2:
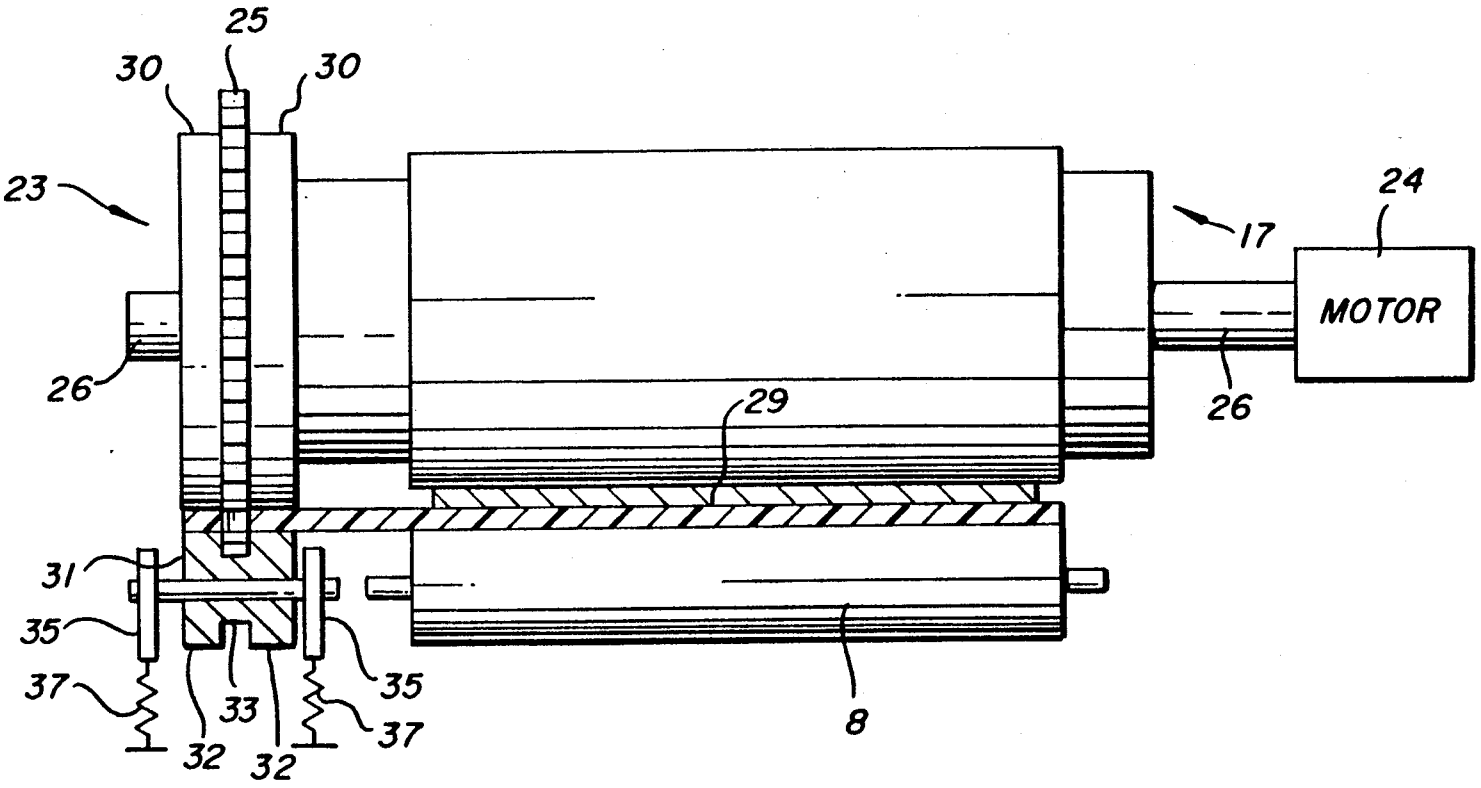
FIG. 2 is a schematic front view of the drive system of the apparatus in accordance with the present invention.

As shown in FIG. 1, a film core portion 1 of the apparatus includes an endless movable belt, such as an electrophotographic belt 2, entrained about a series of rollers 3, 4, 5, 7, and 8. Rollers 3, 4 and 5 are castered and gimballed to maintain substantially equal tension, crosstrack movement and registration of belt 2, throughout its travel, as shown in U.S. Pat. No. 4,572,417. Film skis, 6 also support belt 2 with respect to specific components. Roller 7 is an imaging roller for an LED printhead 10 and roller 8, as shown in FIG. 2, is a back up roller for belt 2, all of the above rollers being known in the art as shown in U.S. Pat. No. 4,821,066. In addition to the above rollers, which are known in the art, belt 2 also travels about a pinch roller 31.

Belt 2, as shown in FIG. 1, is driven, by means discussed below, through a series of electrophotographic stations, generally well-known in the art. More specifically, a uniform charge is laid down on belt 2 at a charging station 9. The uniformly-charged belt 2 moves around an imaging roller 7 directly opposite LED printhead 10 which exposes belt 2 in a manner well-known in the art.

Belt 2 then moves into operative relationship with a series of toner stations 11, 12, 13 and 14, where the image created by exposure using LED printhead 10 is toned. The now toned image proceeds to a transfer station 15, where the image is transferred to a transfer surface, such as a copy sheet 29, that has been delivered by a copy sheet feeding mechanism 16 to transfer station 15. Transfer station 15 includes a transfer drum 17 which cooperates with belt 2 to incrementally bring sheet 29 and the toned image into transfer relation so that the toned image is transferred electrostatically to sheet 29. As is well known in the art, this is generally accomplished at the point where backup roller 8, as shown in FIG. 2, works in cooperation with transfer drum 17 and belt 2.

When the apparatus is operating in a multicolor mode, consecutive images or pairs of images are toned with different colored toners using the different toning stations 11–14, the consecutive images being transferred in registration to transfer surface 29 as it is repeatedly brought into transfer relation with belt 2 by transfer drum 17.

Figure 4:
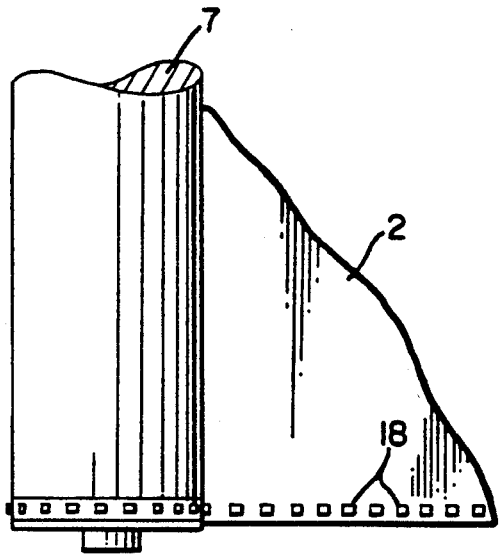
FIG. 4 is a top view of the perforations of the belt.

Coordination between LED printhead 10, belt 2 and transfer drum 17 is provided, in part, by placing a series of perforations 18, as shown in FIG. 4, along one edge of belt 2. A printhead roller sprocket 19, as shown in FIG. 1, is positioned to be engaged by perforations 18 and rotate with belt 2, as belt 2 moves through operative relationship with LED printhead 10. An encoder 20 monitors the angular position of printhead roller sprocket 19 and creates a signal indicative of the angular position. It is also indicative of the location of the edge of perforation 18, in contact with printhead roller sprocket 19. This signal is fed into a printhead drive and control unit 21 which also receives a picture input signal from a data input device 22, such as a scanner, computer, data storage device or the like. The printhead drive and control unit 21 actuates LED printhead 10 according to the angular position of printhead roller sprocket 19. It thus exposes a portion of belt 2 associated with the intrack separation between consecutive engaged edges of perforations 18, as disclosed in U.S. Pat. No. 4,821,066.

As shown in FIG. 2, a two-section transfer sprocket 23 is mounted to one end of transfer drum 17 for driving belt 2. The first section of transfer sprocket 23 contains a series of sprocket teeth 25 which engage perforations 18 to drive belt 2 as transfer sprocket 23 is driven by transfer drum 17. More specifically, transfer drum 17 is driven by a motor 24, through a drive shaft 26, causing it to rotate in a clockwise direction as shown in FIGS. 1 and 2. Rotation of transfer drum 17 causes teeth 25, of transfer sprocket 23, to engage and drive belt 2 through perforations 18.

The second section of transfer sprocket 23 contains a frictional drive surface 30 which makes contact with a first side of belt 2 laterally of perforations 18. In a bias relationship with frictional drive surface 30, through belt 2, is pinch roller 31 consisting of two sections and constructed of a hard non-compliant material. The first section of pinch roller 31 is a contact surface 32 which mates with a second side of belt 2 laterally of perforations 18. The second section of pinch roller 31 is a recess surface 33 in which teeth 25, of sprocket 23, travel. Contact surface 32, of pinch roller 31, urges belt 2 against and into frictional drive contact with frictional drive surface 30, of sprocket 23, resulting in belt 2 being frictionally driven by frictional drive surface 30 of sprocket 23 as sprocket 23 is driven by transfer drum 17. While pinch roller 31 has no independent drive means and the frictional drive created by pinch roller 31 urging belt 2 against frictional drive surface 30 is not as great as the drive provided by sprocket teeth 25 engaging and driving perforations 18, this frictional drive does increase the load-carrying capacity of belt 2. The increased capacity is the result of belt 2 being driven by both a friction drive and a sprocket drive as opposed to just a sprocket drive.

By increasing the load carrying capacity of belt 2, the chances of wearing, tearing or degrading of perforations 18 is greatly reduced. The chances of perforations 18 wearing, tearing or degrading are further reduced by the support provided to the lateral edges of perforation 18 through sandwiching the lateral edges of perforations 18, as perforations 18 are engaged by teeth 25, between frictional drive surface 30 of sprocket 23 and contact surface 32 of pinch roller 31. This sandwiching also assures that perforations 18, of belt 2, will not disengage from sprocket teeth 25, the main drive for belt 2 and the source of image registration. The above increase in load carrying capacity and support greatly prolongs the integrity of perforations 18 and assures good registration and image quality without frequent change of belt 2.

While disengagement, as stated above, could be prevented by means know in the art, such as by a hold down clip disclosed in U.S. Pat. No. 4,068,946 or a shoe disclosed in U.S. Pat. No. 4,821,066, neither the clip nor the shoe, does anything to prolong the integrity of perforations 18.

Figure 3:
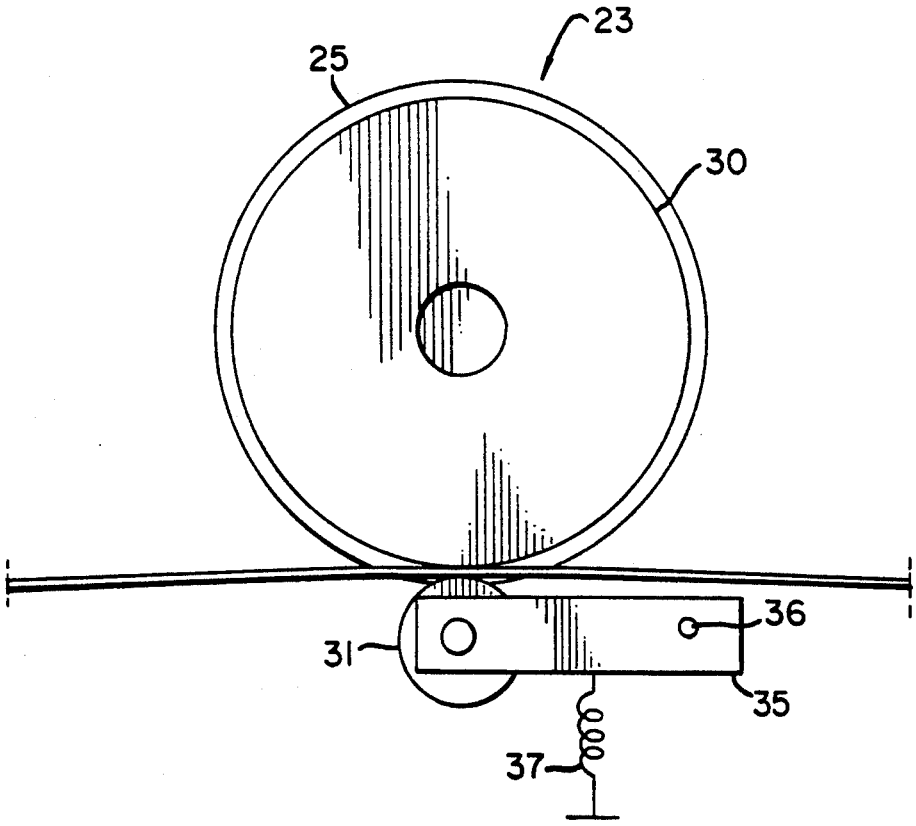
FIG. 3 is a schematic side view of the pinch roller of the apparatus in mating contact with the transfer sprocket in accordance with the present invention.

As shown in FIG. 3, pinch roller 31 is mounted on a spring loaded lever 35. Lever 35 maintains pinch roller 31 against belt 2 by the force exerted upon lever 35 by a compression spring 37. However, when compression spring 37 is disengaged from lever 35, by means known in the art but not shown, lever 35 and pinch roller 31 are free to rotate about shaft 36 and away from belt 2. This releasing aids in the removal of belt 2 from the printer apparatus.

While the present invention has been described with reference to the particular structure disclosed herein, it is not intended that it be limited to the specific details, and this application is intended to cover such modifications or changes as may come within the purposes or scope of the claims forming a part hereof.

I claim:

1. An improved drive system for a recording apparatus of the type having:
   - a belt entrained around a series of rollers;
   - a series of perforations along one edge of the belt;
   - a printhead positioned to form a series of electrostatic images on said belt in response to electronic image information as said belt passes said printhead;
   - means for controlling the printhead;
   - means for toning said electrostatic image to form a toned image; and
   - transfer means positioned to present a transfer surface to said belt to transfer said toned image in registration onto the transfer surface, wherein the improved drive system comprises:
   - an engagement means for driving the belt through the perforations and by frictional contact with the belt;
   - frictional means directly opposite the engagement means for driving and maintaining the belt in contact with the engagement means; and
   - a nip formed by the engagement means and the friction means through which the belt travels.

2. The improvement of claim 1 wherein the engagement means is a sprocket having a first section in mating contact with the perforations of the belt.

3. The improvement of claim 2 wherein the first section of the transfer sprocket is a series of sprocket teeth.

4. The improvement of claim 3 wherein the frictional means is a pinch roller and a second section of the transfer sprocket.

5. The improvement of claim 4 wherein the second section of the transfer sprocket is a frictional surface, and the pinch roller includes a contact surface and a surface having a recess for mating with the series of sprocket teeth.

6. The improvement of claim 5 wherein the belt is located between the frictional surface of the transfer sprocket and the pinch roller.

7. The improvement of claim 6 wherein a biasing means is provided for maintaining both the transfer sprocket and the pinch roller in mating contact with the belt.

8. The improvement of claim 7 wherein the biasing means is a spring for urging and placing the belt into frictional contact with the frictional surface of the transfer sprocket.

9. The improvement of claim 5 wherein the perforations of the belt are located adjacent the frictional surface of the transfer sprocket and adjacent the contact surface of the pinch roller as well as being between the frictional surface of the transfer sprocket and the contact surface of the pinch roller for supporting and increasing the load carrying capacity of the perforations.

10. An image forming apparatus comprising:

means for supporting an endless belt for movement through a path past a series of stations, said belt having a series of perforations along one edge;

means for forming a series of different color, transferable images on said belt;

a transfer drum;

means for transferring the images in registration to a receiving surface associated with said drum to create a multicolor image on the receiving surface;

means for rotating said drum;

a transfer sprocket coupled to said drum for rotation by said drum and positioned to engage the perforations of the belt to drive said belt and control the positioning of the belt by both friction and sprocket drive with respect to the receiving surface, characterized by means defining a frictional drive surface directly opposite the sprocket rotatable with the transfer sprocket for frictionally engaging the belt to also drive the belt and reduce wear on the perforations; and a nip formed by the transfer sprocket and the frictional drive surface through which the belt travels.

11. An improved drive system for a recording apparatus of the type having:

a belt entrained around a series of rollers;

a series of perforations along one edge of the belt;

a printhead positioned to form a series of electrostatic images on said belt in response to electronic image information as said belt passes said printhead;

means for controlling the printhead;

means for toning said electrostatic image to form a toned image; and transfer means positioned to present a transfer surface to said belt to transfer said toned image in registration onto the transfer surface, wherein the improved drive system comprises:

a three component sprocket having a series of sprocket teeth in mating contact with the perforations of the belt and a frictional surface on both sides of the series of sprocket teeth in cooperation with a three component pinch roller directly opposite the sprocket having a surface having a recess in which the series of sprocket teeth travel for driving the belt through the perforations and the pinch roller further having a contact surface on both sides of the recess for providing, in conjunction with the friction surface on both sides of the series of sprocket teeth, a frictional contact drive while maintaining the belt in a nip formed by the frictional surfaces of the sprocket and the contact surfaces of the pinch roller through which the belt travels thereby preventing slipping of the belt when the sprocket teeth are not in contact with the belt.

* * * * *